US012799608B2

(12) United States Patent
Xu et al.

(10) Patent No.: US 12,799,608 B2
(45) Date of Patent: Nov. 17, 2026

(54) METHOD FOR IMPROVING EFFICIENCY OF ELECTROLYTIC SYNTHESIS OF 4-AMINO-3,6-DICHLOROPICOLINIC ACID

(71) Applicant: ZHEJIANG UNIVERSITY OF TECHNOLOGY, Hangzhou (CN)

(72) Inventors: Yinghua Xu, Hangzhou (CN); Jisheng Wang, Hangzhou (CN); Shaoqing Lu, Hangzhou (CN); Huajun Zheng, Hangzhou (CN); Lingxia Zheng, Hangzhou (CN)

(73) Assignee: ZHEJIANG UNIVERSITY OF TECHNOLOGY, Hangzhou (CN)

( * ) Notice: Subject to any disclaimer, the term of this patent is extended or adjusted under 35 U.S.C. 154(b) by 0 days.

(21) Appl. No.: 19/134,557

(22) PCT Filed: Nov. 1, 2023

(86) PCT No.: PCT/CN2023/129109
§ 371 (c)(1),
(2) Date: May 30, 2025

(87) PCT Pub. No.: WO2024/159836
PCT Pub. Date: Aug. 8, 2024

(65) Prior Publication Data

US 2026/0110099 A1 Apr. 23, 2026

(30) Foreign Application Priority Data

Feb. 1, 2023 (CN) ..... 202310050142.8

(51) Int. Cl.
*C25B 3/05* (2021.01)
*C25B 3/07* (2021.01)
(Continued)

(52) U.S. Cl.
CPC ..... *C25B 3/05* (2021.01); *C25B 3/07* (2021.01); *C25B 3/09* (2021.01); *C25B 9/23* (2021.01);
(Continued)

(58) Field of Classification Search
CPC ..... C25B 3/05; C25B 3/25
(Continued)

(56) References Cited

U.S. PATENT DOCUMENTS 6,352,635 B2 3/2002 Krumel et al.
7,666,293 B2 2/2010 Wang et al.
8,685,222 B2 4/2014 Wang et al.

FOREIGN PATENT DOCUMENTS

CN 101522628 A 9/2009
CN 101603179 A 12/2009
(Continued)

*Primary Examiner* — Edna Wong
(74) *Attorney, Agent, or Firm* — MUNCY, GEISSLER, OLDS & LOWE, P.C.

(57) ABSTRACT

A method for improving the efficiency of electrolytic synthesis of 4-amino-3,6-dichloropicolinic acid includes carrying out an electrolytic reaction by means of a diaphragm electrolyzer, with an aqueous solution containing 0.8-2.0 mol/L of 4-amino-3,5,6-trichloropicolinic acid as a catholyte, an aqueous alkali metal hydroxide solution as an anolyte, silver as a cathode and a nickel-based material as an anode; and after the electrolytic reaction is completed, separating and purifying the catholyte to obtain 4-amino-3,6-dichloropicolinic acid. By means of the catholyte and the electrolysis method of the present invention, the current efficiency and the current density are higher, the current efficiency being increased from 42.6% to 62.2-62.6%, and the average current density being increased from 3.3 A/dm2 to 6.8-9.0 A/dm2; and less wastewater is discharged from the production of a 4-amino-3,6-dichloropicolinic acid product,
(Continued)

achieving a decrease from 13 cubic meters to 3.7-4.7 cubic meters for per ton of the product.

9 Claims, 2 Drawing Sheets

(51) Int. Cl.

| | |
|---|---|
| ***C25B 3/09*** | (2021.01) |
| ***C25B 3/25*** | (2021.01) |
| ***C25B 9/23*** | (2021.01) |
| ***C25B 11/03*** | (2021.01) |
| ***C25B 11/042*** | (2021.01) |
| ***C25B 15/08*** | (2006.01) |
| ***C25D 11/34*** | (2006.01) |

(52) U.S. Cl.
CPC ..... *C25B 11/03* (2013.01); *C25B 11/042* (2021.01); *C25B 15/085* (2021.01); *C25D 11/34* (2013.01)

(58) Field of Classification Search
USPC ..... 205/426
See application file for complete search history.

(56) References Cited

FOREIGN PATENT DOCUMENTS

| | | | | | |
|---|---|---|---|---|---|
| CN | 104988531 | A | | 10/2015 | |
| CN | 105887128 | A | | 8/2016 | |
| CN | 108611656 | A | | 10/2018 | |
| CN | 110438522 | A | * | 11/2019 | ..... C25B 3/00 |
| CN | 110656345 | A | | 1/2020 | |
| CN | 114032566 | A | | 2/2022 | |
| CN | 114075675 | A | | 2/2022 | |
| CN | 116288430 | A | | 6/2023 | |
| WO | WO-2008042429 | A1 | * | 4/2008 | ..... C07D 213/803 |

* cited by examiner

METHOD FOR IMPROVING EFFICIENCY OF ELECTROLYTIC SYNTHESIS OF 4-AMINO-3,6-DICHLOROPICOLINIC ACID

TECHNICAL FIELD

The present invention relates to a method for improving the efficiency of electrolytic synthesis of 4-amino-3,6-dichloropicolinic acid.

BACKGROUND OF THE INVENTION 4-amino-3,6-dichloropicolinic acid, commercially known as aminopyralid, clopyralid, or dichloraminopyridine, is a pyridine carboxylic acid herbicide that rapidly penetrates plants, disrupting their growth and causing swift death. It is primarily utilized for weed control in pastures, plantations, and non-crop areas. Additionally, 4-amino-3,6-dichloropicolinic acid serves as a critical intermediate in the synthesis of florpyrauxifen and halauxifen-methyl, which are novel aryl pyridine carboxylate herbicides developed by Dow AgroSciences. These herbicides represent a new class of hormonal herbicides with advantages such as lower dosage and broader weed control spectra.

U.S. Pat. Nos. 6,352,635, 7,666,293, and 8685222 disclose a method for the electrochemical selective dechlorination of 4-amino-3,5,6-trichloropicolinic acid to prepare 4-amino-3,6-dichloropyridine methyl acid. The method employs a undivided electrolytic cell as the reactor, Hastelloy C as the anode material, and an activated silver mesh as the cathode material, with an alkaline aqueous solution containing 4-amino-3,5,6-trichloropicolinic acid serving as the electrolyte. After electrolysis, the product is precipitated by acidifying the electrolyte. However, the method suffers from three major limitations: (1) low current density; (2) suboptimal product purity and reddish discoloration; and (3) excessive wastewater discharge.

To address the first issue, Chinese patents (e.g., CN 201611135958, CN 201910781536) proposed modified electrochemical selective dechlorination methods using a diaphragm electrolytic cell as the reactor. These methods employ an alkaline or hydrochloric acid-containing aqueous solution as the anolyte and an alkaline aqueous solution containing 4-amino-3,5,6-trichloropicolinic acid as the catholyte. While these modifications prevent direct contact between the substrate/product and the anode material—thereby mitigating purity degradation and reddening—the issues of "low current density," "high wastewater volume," and "expensive noble metal anode materials" remain unresolved.

BRIEF SUMMARY OF THE INVENTION

The purpose of this invention is to provide a method for improving efficiency of electrolytic synthesis of 4-amino-3,6-dichloropicolinic acid. By using a fully dissolved aqueous solution containing high concentration of 4-amino-3,5,6-trichloropicolinic acid as a catholyte, not only can the electrolytic current density be significantly increased, but also the amount of waste liquid discharged can be reduced, solving the problems of "low current density", "large amount of waste liquid discharge", and/or "use of expensive precious metal anodes" in existing technologies.

The technical solutions adopted in this invention are as follows:

The present invention provides a method for improving efficiency of electrolytic synthesis of 4-amino-3,6-dichloropicolinic acid, which comprises: employing a diaphragm electrolytic cell, using an aqueous solution containing 0.8 to 2.0 mol/L of 4-amino-3,5,6-trichloropicolinic acid (I) as a catholyte, an aqueous solution containing an alkali metal hydroxide as an anolyte, silver (preferably with a purity of ≥99.5 wt %) as a cathode, and a nickel-based material as an anode; applying direct current or pulse current sequentially through the anolyte, diaphragm, and catholyte from the anode to the cathode for electrolytic reaction, after the electrolytic reaction is completed, subjecting the catholyte to separation and purification, thereby obtaining 4-amino-3,6-dichloropicolinic acid (II).

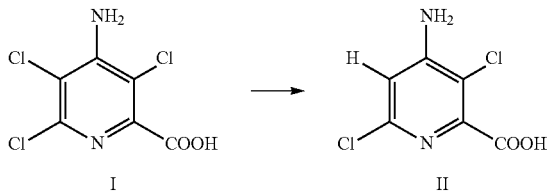

Preferably, the catholyte is prepared by first increasing the temperature and then decreasing it to achieve a fully dissolved or clarified state, and the specific preparation method comprises: adding 4-amino-3,5,6-trichloropicolinic acid to an aqueous solution of an alkali metal hydroxide or alkali metal carbonate, subjecting the mixture to stirring and dissolution at 50-100° C. until it becomes clear, and finally cooling it down to 30-80° C. to obtain a clear catholyte.

More preferably, during the preparation process of the catholyte, the time for stirring and dissolution is 10-40 minutes; the temperature for stirring and dissolution is preferably 60-90° C., and most preferably the stirring and dissolution is performed at 70° C. for 30 minutes.

Preferably, in the preparation method of the catholyte, the alkali metal hydroxide is NaOH or KOH, and the alkali metal carbonate is sodium carbonate or potassium carbonate; in the aqueous solution of the alkali metal hydroxide or alkali metal carbonate, the concentration of the alkali metal hydroxide is 0.5-2 mol/L (preferably 1.2-1.6 mol/L), and the concentration of the alkali metal carbonate is 0.25-1 mol/L (preferably 0.6-0.8 mol/L); the molar ratio of the alkali metal hydroxide or alkali metal carbonate in the aqueous solution of the alkali metal hydroxide or alkali metal carbonate to 4-amino-3,5,6-trichloropicolinic acid is 0.1-1:1, preferably 1:1.

Preferably, the anolyte is an aqueous solution of an alkali metal hydroxide, wherein the alkali metal hydroxide is NaOH or KOH, and the concentration of the alkali metal hydroxide in the anolyte is 0.5-10 mol/L (preferably 1-3 mol/L). Because the concentration of the alkali metal hydroxide gradually decreases during the electrolysis process, the usual practice is to maintain the required concentration by adding additional alkali metal hydroxide.

Both the catholyte and the anolyte are prepared using deionized water or distilled water.

Preferably, the current density for the electrolysis reaction is 2.2~20 A/dm$^2$ (preferably 5~12 A/dm$^2$), and the temperature for the electrolysis reaction is 30~80° C. (preferably 45~65° C.). The preferred current control method is as follows: during the initial stage of the electrolysis reaction, a current density of 8~20 A/dm$^2$ is used; during the intermediate stage, a current density of 4.5~11.2 A/dm$^2$ is used; and during the final stage, a current density of 2.2~5.5 A/dm$^2$ is used. More preferably, the current density is maintained at 8~20 A/dm$^2$ for 2 hours, 4.5~11.2 A/dm$^2$ for 2 hours, and 2.2~5.5 A/dm$^2$ for 3 hours, with an average current density of 4.5~10.5 A/dm$^2$.

The silver of the cathode can be in any shape, such as mesh, plate, and foam, with mesh being preferred. The silver mesh referred to is an activated silver mesh. An optional method for activating the silver mesh includes: in an aqueous solution containing chloride or bromide ions, first oxidizing the silver mesh as an anode until oxygen gas is evolved, and then reducing it as a cathode until hydrogen gas is evolved; optionally, the current density for the oxidation-reduction process is 0.1 to 5 A/dm$^2$, preferably 0.2 to 1 A/dm$^2$; the temperature is 0 to 50° C., preferably 20 to 40° C.

Preferably, the cathode is an activated silver mesh, and the activation method for the silver mesh comprises: in an H-type electrolytic cell with a Nafion 117 cation membrane as a diaphragm, using the silver mesh (with a purity of 99.5 wt % and dimensions of 0.1 cm×2.0 cm×3.0 cm) as a working electrode, graphite as a counter electrode, silver/silver chloride as a reference electrode, 30 mL of a 0.5 M NaCl and 0.5 M NaOH aqueous solution as a working electrode solution, and 30 mL of a 1.0 M NaOH aqueous solution as a counter electrode solution, controlling the temperature of the working electrode solution at 20-25° C., first applying an anodic oxidation current of 0.3 A/dm$^2$ to the silver mesh until the electrode potential reaches +0.7 vs. SHE (relative to the standard hydrogen electrode potential), then reversing the current direction and applying a cathodic reduction current of 0.3 A/dm$^2$ to the silver mesh until the electrode potential reaches −0.4 vs. SHE; finally, removing the silver electrode and immersing it in deionized water to obtain the activated silver mesh.

The nickel-based material can be pure nickel, stainless steel, nickel alloy, preferably Hastelloy C-276; and the shape of the nickel-based material can be plate-like, mesh-like, and foam-like, preferably mesh-like.

Preferably, the separation and purification method for the catholyte comprises: adjusting the pH of the catholyte to 1 using 36% concentrated hydrochloric acid (by mass) at 85-90° C., and allowing it to cool naturally overnight for crystallization; filtering the precipitated crystals, washing them with water, and drying them at 80° C. to obtain snow-white crystals, which are 4-amino-3,6-dichloropicolinic acid.

Preferably, the diaphragm is a cation exchange membrane, which includes a sulfonic acid membrane, a phosphoric acid membrane, or a carboxylic acid membrane, with sulfonic acid membrane being preferred. Alternatively, porous diaphragms including asbestos diaphragm and plastic diaphragm can also be used.

The specific structure of the diaphragm electrolytic cell described in this invention can be selected according to the reaction requirements. In the laboratory stage, a glass-made H-type electrolytic cell can be used; in the small-scale, pilot-scale, and production stages, a plate-and-frame electrolytic cell can be used. The specific structure of the electrolytic cell is not the most critical, and it can be designed and manufactured based on professional knowledge in this field.

Compared with existing technologies, the beneficial effects of the present invention are mainly reflected in:

(1) The preparation method of the catholyte provided by this invention can completely dissolve 1-2 mol/L 4-amino-3,5,6-trichloropicolinic acid within 40 minutes; after cooling to 40-75° C., 4-amino-3,5,6-trichloropicolinic acid still maintains a completely dissolved state; compared to existing catholytes, the dissolution concentration of 4-amino-3,5,6-trichloropicolinic acid is increased by 1-1.6 mol/L.

(2) By using the catholyte of this invention, while maintaining the product yield, the current efficiency and current density of the method of this invention are increased (the current efficiency increased from 42.6% (Comparative Example 3) to 62.2-62.8% (Examples 10 and 14); the average current density increased from 3.3 A/dm$^2$ (Comparative Example 3) to 6.8-9.0 A/dm$^2$ (Examples 10 and 14).

(3) Using the catholyte of this invention, the amount of wastewater discharged per ton of 4-amino-3,6-dichloropicolinic acid product synthesized is reduced, from 13 cubic meters (comparative example 3) to 3.7-4.7 cubic meters (examples 10 and 14).

(4) By utilizing the catholyte of this invention, the electrolytic synthesis of 4-amino-3,6-dichloropicolinic acid can be achieved without the use of precious metal anodes, thereby reducing costs.

DETAILED DESCRIPTION OF THE INVENTION

The present invention will be further described below in conjunction with specific examples, but the scope of protection of the present invention is not limited thereto:

In the examples of the present invention, all aqueous solutions are prepared using deionized water.

The definition of average current density ($I_m$) is as follows: $I_m=(I_1\times t_1+I_2\times t_2+I_3\times t_3)/t$, where $I_1$, $I_2$, and $I_3$ represent the current densities in the first, second, and third time periods, respectively; and $t_1$, $t_2$, and $t_3$ represent the energization times in the first, second, and third time periods, respectively.

The H-type electrolytic cell with Nafion 117 cation membrane as the diaphragm has a distance of approximately 8 cm between the anode and cathode, with the ion membrane placed centrally. The area of the ion membrane is 3.14×2×2=12.56 cm$^2$.

Example 1: Preparation of Activated Silver Mesh Electrode

Figure 1:
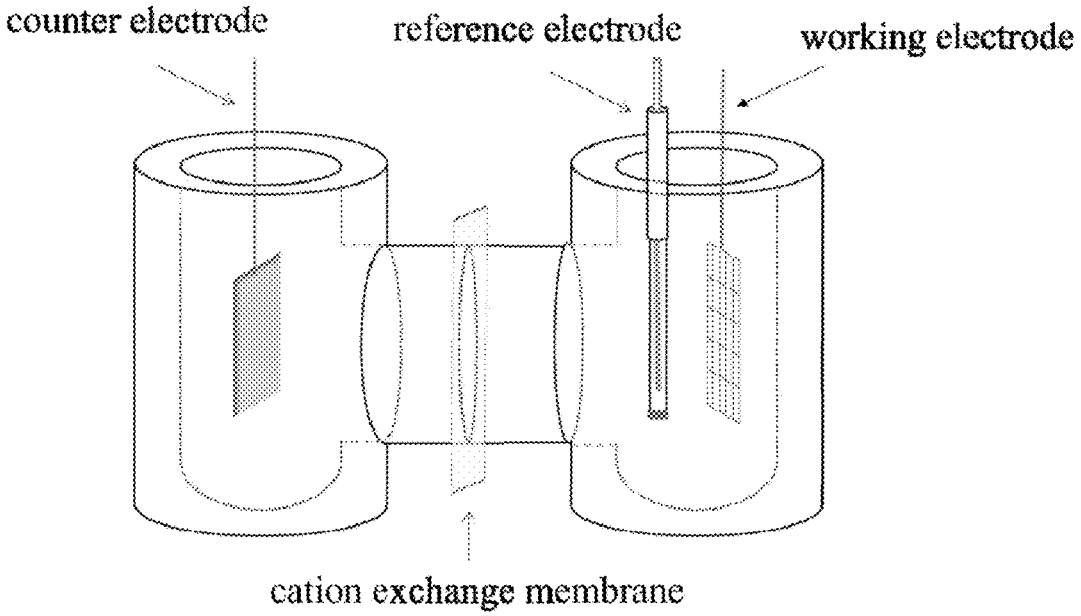
FIG. 1 is a schematic diagram of an H-type electrolytic cell with a Nafion 117 cation membrane as the diaphragm.

An H-type electrolytic cell using a Nafion 117 cationic membrane as a diaphragm (as illustrated in FIG. 1) was employed, wherein a silver mesh (with a purity of 99.5 wt % and dimensions of 0.1 cm×2.0 cm×3.0 cm) was used as the working electrode; a graphite sheet of the same area was used as the counter electrode; and a silver/silver chloride electrode was used as the reference electrode. A 30 mL aqueous solution containing 0.5 mol/L NaCl and 0.5 mol/L NaOH was used as the working electrode solution, while a 30 mL aqueous solution of 1.0 mol/L sodium hydroxide was used as the counter electrode solution. The temperature of the working electrode solution was controlled at 20-25° C. Initially, an anodic oxidation current of 0.3 A/dm$^2$ was applied to the silver mesh until the electrode potential reached +0.7 V vs. SHE (relative to the standard hydrogen electrode); subsequently, the current direction was reversed, and a cathodic reduction current of 0.3 A/dm$^2$ was applied to the silver mesh until the electrode potential reached −0.4 V vs. SHE. The silver electrode was then removed, placed in deionized water, and stored as an activated silver mesh for subsequent use.

Example 2: The Catholyte was Prepared at 60° C.-0.8 mol/L

A 50 mL beaker was charged with 30 mL of a 0.8 mol/L aqueous NaOH solution, followed by the addition of 5.8 g (24 mmol) of 4-amino-3,5,6-trichloropicolinic acid. The mixture was stirred at 60° C. for 25 minutes until a clear solution was formed. The solution was cooled to 30° C., and it remained clear, which was then used as the catholyte for subsequent use.

Examples 3-6: Catholyte Preparation at Varying Concentrations and Temperatures

According to the parameters in Table 1, NaOH was added in the form of 30 mL aqueous solutions with varying concentrations, maintaining a molar ratio of 1:1 between NaOH and 4-amino-3,5,6-trichloropicolinic acid. The experiments were conducted following the procedure described in Example 2, and the other operations and parameters were the same as example 2. The results demonstrated that 1-2 mol/L 4-amino-3,5,6-trichloropicolinic acid could be rapidly and completely dissolved in aqueous NaOH solutions at 70-90° C. After cooling to 40-75° C., 4-amino-3,5,6-trichloropicolinic acid remained fully dissolved.

Compared with the NaOH aqueous solution with a constant temperature of 45° C. (Comparative Examples 1 and 2), the NaOH aqueous solution with a temperature of 70-90° C. combined with cooling to 40-75° C. not only dissolved 4-amino-3,5,6-trichloropicolinic acid at a higher concentration and in a shorter time, but also maintained a fully dissolved state.

TABLE 1

Preparation of Catholytes at varying concentrations and temperatures

| Experiment number | Addition amount of 4-amino-3,5,6-trichloropicolinic acid/mmol | Addition amount of NaOH/mmol | Temperature and time for stirring and dissolution of 4-amino-3,5,6-trichloropicolinic acid | Temperature and state of the solution after cooling down |
|---|---|---|---|---|
| 3 | 30 | 30 | 70° C./20 min | 40° C./clear |
| 4 | 36 | 36 | 70° C./30 min | 45° C./clear |
| 5 | 48 | 48 | 80° C./35 min | 60° C./clear |
| 6 | 80 | 80 | 90° C./40 min | 75° C./clear |

Comparative Example 1 (Primarily Compared with Example 4): Catholyte Preparation at 45° C.

A 50 mL beaker was charged with 30 mL of a 1.2 mol/L aqueous NaOH solution, followed by the addition of 36 mmol of 4-amino-3,5,6-trichloropicolinic acid powder. The mixture was stirred at 45° C. for 240 minutes, but the solution remained slurry-like and was used as the catholyte for subsequent use.

Comparative Example 2 (Primarily Compared with Example 4): Catholyte Preparation at 45° C.

A 50 mL beaker was charged with 30 mL of a 0.4 mol/L aqueous NaOH solution, followed by the addition of 12 mmol of 4-amino-3,5,6-trichloropicolinic acid powder. The mixture was stirred at 45° C. for 30 minutes until a clear solution was formed, which was then used as the catholyte for subsequent use.

Example 7: Catholyte Preparation at 70° C. Using $Na_2CO_3$

A 50 mL beaker was charged with 30 mL of a 0.6 mol/L aqueous $Na_2CO_3$ solution, followed by the addition of 36 mmol of 4-amino-3,5,6-trichloropicolinic acid powder. The mixture was stirred at 70° C. for 30 minutes until a clear solution was formed. After cooling to 45° C., the solution remained clear and was used as the catholyte for subsequent use.

Example 8: Catholyte Preparation at 70° C. Using $K_2CO_3$

A 50 mL beaker was charged with 30 mL of a 0.6 mol/L aqueous $K_2CO_3$ solution, followed by the addition of 36 mmol of 4-amino-3,5,6-trichloropicolinic acid powder. The mixture was stirred at 70° C. for 30 minutes until a clear solution was formed. After cooling to 45° C., the solution remained clear and was used as the catholyte for subsequent use.

Example 9: Catholyte Preparation at 90° C. Using NaOH

A 50 mL beaker was charged with 30 mL of a 1.2 mol/L aqueous NaOH solution, followed by the addition of 36 mmol of 4-amino-3,5,6-trichloropicolinic acid powder. The mixture was stirred at 90° C. for 10 minutes until a clear solution was formed. After cooling to 75° C., the solution remained clear and was used as the catholyte for subsequent use.

Example 10: Electrolysis of 1.2 mol/L 4-Amino-3,5,6-Trichloropicolinic Acid

In an H-type electrolytic cell using a Nafion 117 cationic membrane as a diaphragm (FIG. 1), the activated silver mesh (prepared by the method of Example 1, with dimensions of 0.1 cm×2.0 cm×3.0 cm) was used as the cathode, and a Hastelloy C-276 mesh (HC-276, geometric dimensions of 0.1 cm×2.0 cm×3.0 cm) was used as the anode. The anolyte was 60 mL of a 2.0 mol/L aqueous NaOH solution, and the catholyte was 30 mL of the solution prepared by the method of Example 4. The catholyte was stirred at 45±2° C. while currents of 0.72 A (12 A/dm$^2$) for 2 hours, 0.4 A (6.7 A/dm$^2$) for 2 hours, and 0.2 A (3.3 A/dm$^2$) for 3 hours were sequentially applied (average current density=6.8 A/dm$^2$). Electrolysis was terminated after 7 hours. Subsequent HPLC analysis of the catholyte revealed a 97.6% conversion rate of 4-amino-3,5,6-trichloropicolinic acid and a 92.1% yield of 4-amino-3,6-dichloropicolinic acid in the catholyte, with a current efficiency of 62.6%. Finally, the pH of the catholyte was adjusted to 1 using 36% (mass concentration) concentrated hydrochloric acid at 85-90° C., followed by overnight natural cooling for crystallization. The precipitated crystals were filtered, washed with water, and dried at 80° C. to obtain 6.3 g of snow-white crystals identified as 4-amino-3,6-dichloropicolinic acid. HPLC analysis confirmed a purity of 98.6% for 4-amino-3,6-dichloropicolinic acid in the white crystals. Approximately 27 mL of wastewater after crystallization filtration and 5 mL of washing wastewater were generated.

The HPLC conditions were as follows: a C18 Symmetry column (250 mm length_4.6 mm i.d., 5 mm particle size) was used as the separator column; a mixture of acetonitrile/methanol/water (1:3:6 by volume) containing 30 mmol/L phosphoric acid was used as the mobile phase; the flow rate was 1 mL/min; the detection wavelength was 230 nm; and a Waters 2996 PDA detector was employed.

Compared with Comparative Example 3, the average current density was increased by 3.46 A/dm$^2$, the current efficiency was increased by 20%, and the wastewater volume per ton of 4-amino-3,6-dichloropicolinic acid synthesized was reduced by 8.3 cubic meters (from 13 cubic meters to 4.7 cubic meters).

Comparative Example 3 (Primarily Compared with Example 10): Electrolysis of 0.4 mol/L 4-Amino-3,5,6-Trichloropicolinic Acid In an H-type electrolytic cell using a Nafion 117 cationic membrane as a diaphragm (FIG. 1), the activated silver mesh (prepared by the method of Example 1, with dimensions of 0.1 cm×2.0 cm×3.0 cm) was used as the cathode, and HC-276 (geometric dimensions of 0.1 cm×2.0 cm×3.0 cm) was used as the anode. The anolyte was 60 mL of a 2.0 mol/L aqueous NaOH solution, and the catholyte was 30 mL of the solution prepared by the method of Comparative Example 2. The catholyte was stirred at 45±2° C. while a current of 0.2 A (3.3 A/dm$^2$) was applied for 7 hours. Subsequent HPLC analysis of the catholyte revealed a 98.1% conversion rate of 4-amino-3,5,6-trichloropicolinic acid and a 91.8% yield of 4-amino-3,6-dichloropicolinic acid in the catholyte, with a current efficiency of 42.6%. Finally, the pH of the catholyte was adjusted to 1 using 36% (mass concentration) concentrated hydrochloric acid at 85-90° C., followed by overnight natural cooling for crystallization. The precipitated crystals were filtered, washed with water, and dried at 80° C. to obtain snow-white crystals. HPLC analysis confirmed a purity of 98.9% for 4-amino-3,6-dichloropicolinic acid in the white crystals. Approximately 27 mL of wastewater after crystallization filtration and 3 mL of washing wastewater were generated.

Compared with Example 10, the average current density was decreased by 3.5 A/dm$^2$, the current efficiency was decreased by 20%, and the wastewater volume per ton of 4-amino-3,6-dichloropicolinic acid synthesized was increased by 8.3 cubic meters.

Comparative Example 4 (Primarily Compared with Example 10): Electrolysis of 1.2 mol/L 4-Amino-3,5,6-Trichloropicolinic Acid In an H-type electrolytic cell using a Nafion 117 cationic membrane as a diaphragm (FIG. 1), the activated silver mesh (prepared by the method of Example 1, with dimensions of 0.1 cm×2.0 cm×3.0 cm) was used as the cathode, and a Hastelloy C-276 mesh (HC-276, geometric dimensions of 0.1 cm×2.0 cm×3.0 cm) was used as the anode. The anolyte was 60 mL of a 2.0 mol/L aqueous NaOH solution, and the catholyte was 30 mL of the solution prepared by the method of Comparative Example 1. The catholyte was stirred at 45±2° C. while currents of 0.72 A (12 A/dm$^2$) for 2 hours, 0.4 A (6.7 A/dm$^2$) for 2 hours, and 0.2 A (3.3 A/dm$^2$) for 3 hours were sequentially applied (average current density=6.8 A/dm$^2$). Electrolysis was terminated after 7 hours. Subsequent HPLC analysis of the catholyte revealed a 77.5% conversion rate of 4-amino-3,5,6-trichloropicolinic acid and a 72.6% yield of 4-amino-3,6-dichloropicolinic acid in the catholyte, with a current efficiency of 49.4%.

Compared with Example 10, the conversion rate of 4-amino-3,5,6-trichloropicolinic acid was reduced by 20.6%, the yield of 4-amino-3,6-dichloropicolinic acid was decreased by 19.5%, and the current efficiency was lowered by 13.2%.

Examples 11-16: Electrolysis of 0.8-2 mol/L 4-Amino-3,5,6-Trichloropicolinic Acid According to the parameters in Table 2, experiments were conducted following the procedure described in Example 10, and other operations and parameters were the same as those in Example 10. The results demonstrated that 4-amino-3,5,6-trichloropicolinic acid at concentrations of 0.8-2.0 mol/L (particularly 1.2-1.6 mol/L) could be efficiently converted to 4-amino-3,6-dichloropicolinic acid with high current density, high yield, and high current efficiency. Compared with Comparative Example 3, significant increases in current density and current efficiency were achieved, and the wastewater volume per ton of product synthesized was substantially reduced. Compared with Comparative Example 4, marked improvements in current efficiency, conversion rate, and product yield were observed.

TABLE 2

Electrolysis Experiment Parameters

| Serial number of examples | Catholyte | Reaction temperature (° C.) | Power on program | Average current density (Im) | Raw material conversion | Product yield | current efficiency | wastewater discharge per ton of product (in $m^3$) |
|---|---|---|---|---|---|---|---|---|
| 11[a] | Prepared by the method of Example 2 | 30~35 | 8 A/dm$^2$ (2 h)→4.5 A/dm$^2$ (2 h)→2.2 A/dm$^2$ (3 h) | 4.5 A/dm$^2$ | 98.1% | 89.6% | 60.8% | 7.2 |
| 12 | Prepared by the method of Example 3 | 40~45 | 10 A/dm$^2$ (2 h)→5.6 A/dm$^2$ (2 h)→2.75 A/dm$^2$ (3 h) | 5.6 A/dm$^2$ | 97.2% | 91.1% | 61.9% | 5.7 |
| 13 | Prepared by the method of Example 6 | 75~80 | 20 A/dm$^2$ (2 h)→11.2 A/dm$^2$ (2 h)→5.5 A/dm$^2$ (3 h) | 11.3 A/dm$^2$ | 97.5% | 85.6% | 58.2% | 3.3 |
| 14 | Prepared by the method of Example 5 | 60~65 | 16 A/dm$^2$ (2 h)→8.9 A/dm$^2$ (2 h)→4.4 A/dm$^2$ (3 h) | 9.0 A/dm$^2$ | 97.5% | 91.4% | 62.2% | 3.7 |

[a]The anolyte is a 1.5 mol/L NaOH aqueous solution

Example 15: Electrolysis of Approximately 1.2 mol/L 4-Amino-3,5,6-Trichloropicolinic Acid—$Na_2CO_3$ In an H-type electrolytic cell using a Nafion 117 cationic membrane as a diaphragm (FIG. 1), the activated silver mesh (prepared by the method of Example 1, with dimensions of 0.1 cm×2.0 cm×3.0 cm) was used as the cathode, and a 316 L stainless steel mesh (geometric dimensions of 0.1 cm×2.0 cm×3.0 cm) was used as the anode. The anolyte was 60 mL of a 4.0 mol/L aqueous NaOH solution, and the catholyte was 30 mL of the solution prepared by the method of Example 7. The catholyte was stirred at 45±2° C. while currents of 0.72 A (12 A/dm$^2$) for 2 hours, 0.4 A (6.7 A/dm$^2$) for 2 hours, and 0.2 A (3.3 A/dm$^2$) for 3 hours were sequentially applied (average current density=6.8 A/dm$^2$). Electrolysis was terminated after 7 hours. Subsequent HPLC analysis of the catholyte revealed a 97.2% conversion rate of 4-amino-3,5,6-trichloropicolinic acid and a 91.5% yield of 4-amino-3,6-dichloropicolinic acid in the catholyte, with a current efficiency of 62.2%. Finally, the pH of the catholyte was adjusted to 1 using 36% (mass concentration) concentrated hydrochloric acid at 85-90° C., followed by overnight natural cooling for crystallization. The precipitated crystals were filtered, washed with water, and dried at 80° C. to obtain 6.1 g of snow-white crystals identified as 4-amino-3,6-dichloropicolinic acid. HPLC analysis confirmed a purity of 98.5% for 4-amino-3,6-dichloropicolinic acid in the white crystals. Approximately 27 mL of wastewater after crystallization filtration and 5 mL of washing wastewater were generated.

Example 16: Electrolysis of Approximately 1.2 mol/L 4-Amino-3,5,6-Trichloropicolinic Acid—$K_2CO_3$ In an H-type electrolytic cell using a Nafion 117 cationic membrane as a diaphragm (FIG. 1), the activated silver mesh (prepared by the method of Example 1, with dimensions of 0.1 cm×2.0 cm×3.0 cm) was used as the cathode, and a 316 L stainless steel mesh (geometric dimensions of 0.1 cm×2.0 cm×3.0 cm) was used as the anode. The anolyte was 60 mL of a 4.0 mol/L aqueous KOH solution, and the catholyte was 30 mL of the solution prepared by the method of Example 8. The catholyte was stirred at 45±2° C. while currents of 0.72 A (12 A/dm$^2$) for 2 hours, 0.4 A (6.7 A/dm$^2$) for 2 hours, and 0.2 A (3.3 A/dm$^2$) for 3 hours were sequentially applied (average current density=6.8 A/dm$^2$). Electrolysis was terminated after 7 hours. Subsequent HPLC analysis of the catholyte revealed a 97.5% conversion rate of 4-amino-3,5,6-trichloropicolinic acid and a 92.5% yield of 4-amino-3,6-dichloropicolinic acid in the catholyte, with a current efficiency of 62.9%. Finally, the pH of the catholyte was adjusted to 1 using 36% (mass concentration) concentrated hydrochloric acid at 85-90° C., followed by overnight natural cooling for crystallization. The precipitated crystals were filtered, washed with water, and dried at 80° C. to obtain 6.2 g of snow-white crystals identified as 4-amino-3,6-dichloropicolinic acid. HPLC analysis confirmed a purity of 98.2% for 4-amino-3,6-dichloropicolinic acid in the white crystals. Approximately 27 mL of wastewater after crystallization filtration and 5 mL of washing wastewater were generated.

Example 17: Electrolysis of Approximately 1.2 mol/L 4-Amino-3,5,6-Trichloropicolinic Acid—75-80° C.

In an H-type electrolytic cell using a Nafion 117 cationic membrane as a diaphragm (FIG. 1), the activated silver mesh (prepared by the method of Example 1, with dimensions of 0.1 cm×2.0 cm×3.0 cm) was used as the cathode, and a 316 L stainless steel mesh (geometric dimensions of 0.1 cm×2.0 cm×3.0 cm) was used as the anode. The anolyte was 60 mL of a 4.0 mol/L aqueous NaOH solution, and the catholyte was 30 mL of the solution prepared by the method of Example 9. The catholyte was stirred at 75-80° C. while currents of 0.72 A (12 A/dm$^2$) for 2 hours, 0.4 A (6.7 A/dm$^2$)

for 2 hours, and 0.2 A (3.3 A/dm$^2$) for 3 hours were sequentially applied (average current density=6.8 A/dm$^2$). Electrolysis was terminated after 7 hours. Subsequent HPLC analysis of the catholyte revealed a 97.7% conversion rate of 4-amino-3,5,6-trichloropicolinic acid and an 84.9% yield of 4-amino-3,6-dichloropicolinic acid in the catholyte, with a current efficiency of 57.7%. Finally, the pH of the catholyte was adjusted to 1 using 36% (mass concentration) concentrated hydrochloric acid at 85-90° C., followed by overnight natural cooling for crystallization. The precipitated crystals were filtered, washed with water, and dried at 80° C. to obtain 5.8 g of snow-white crystals identified as 4-amino-3,6-dichloropicolinic acid. HPLC analysis confirmed a purity of 96.2% for 4-amino-3,6-dichloropicolinic acid in the white crystals. Approximately 27 mL of wastewater after crystallization filtration and 5 mL of washing wastewater were generated.

Example 18: Scale-Up Experiment

Figure 2:
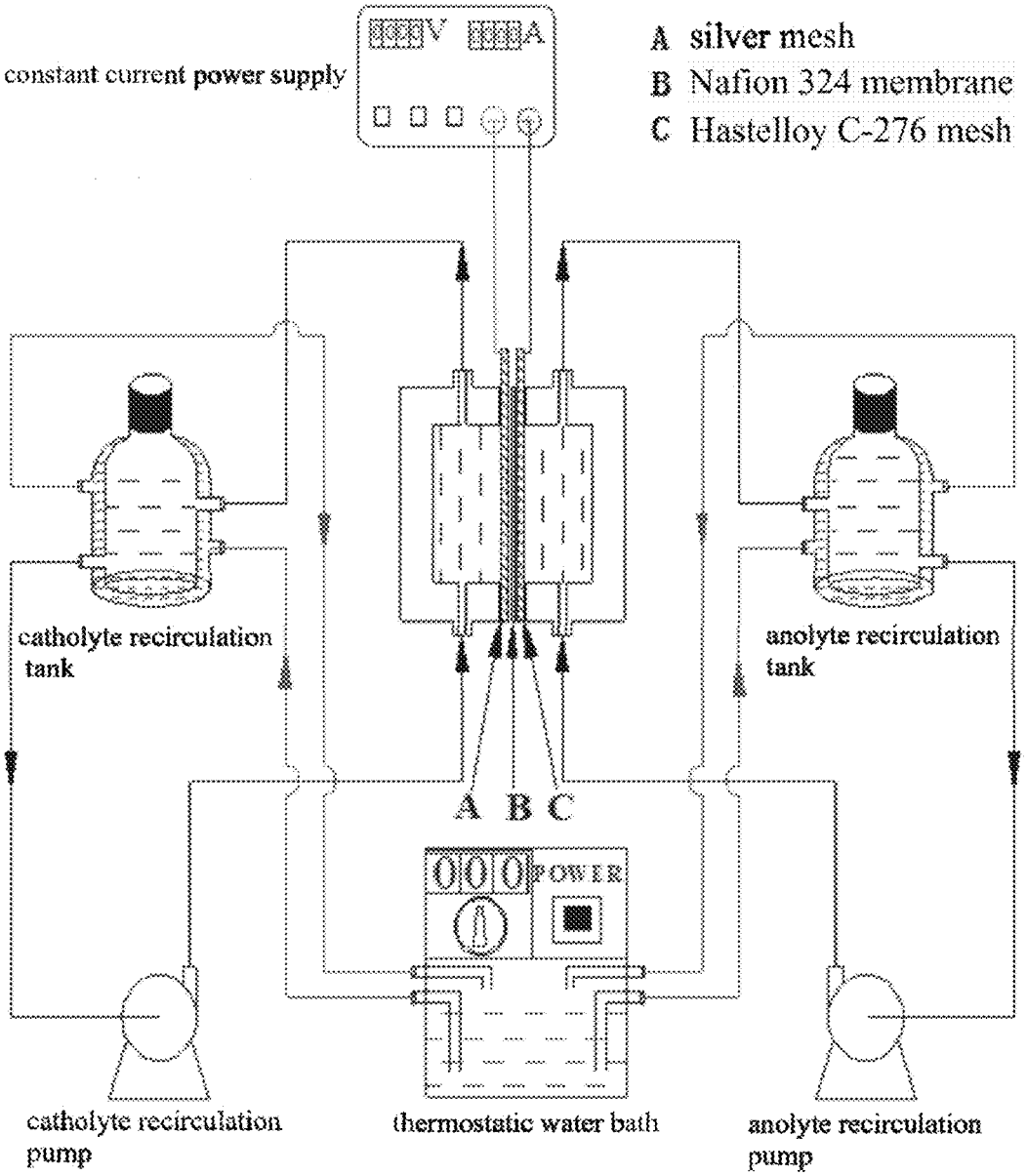
FIG. 2 depicts a plate-and-frame electrolytic cell utilizing a Nafion 324 cation membrane as the diaphragm, along with its accompanying reaction apparatus.

In a plate-and-frame electrolytic cell using a Nafion 324 cationic membrane as a diaphragm (FIG. 2), the activated silver mesh (prepared by the method of Example 1, with dimensions of 0.1 cm×10 cm×20 cm) was used as the cathode, and a Hastelloy C-276 mesh (HC-276, geometric dimensions of 0.1 cm×10 cm×20 cm) was used as the anode. The anolyte was 2 L of a 2.0 mol/L aqueous NaOH solution, and the catholyte was 1 L of the solution prepared by the method of Example 4. The catholyte was stirred at 45±3° C. using a circulation pump while currents of 24 A (12 A/dm$^2$) for 2 hours, 13.3 A (6.7 A/dm$^2$) for 2 hours, and 6.67 A (3.3 A/dm$^2$) for 3 hours were sequentially applied (average current density=6.8 A/dm$^2$). Electrolysis was terminated after 7 hours. Subsequent HPLC analysis of the catholyte revealed a 98.2% conversion rate of 4-amino-3,5,6-trichloropicolinic acid and a 93.2% yield of 4-amino-3,6-dichloropicolinic acid in the catholyte, with a current efficiency of 63.4%.

The invention claimed is:

1. A method for improving efficiency of electrolytic synthesis of 4-amino-3,6-dichloropicolinic acid, comprising:

employing a diaphragm electrolytic cell, using an aqueous solution containing 0.8 to 2.0 mol/L of 4-amino-3,5,6-trichloropicolinic acid as a catholyte, an aqueous solution containing an alkali metal hydroxide as an anolyte, silver as a cathode, and a nickel-based material as an anode for electrolytic reaction, after the electrolytic reaction is completed, subjecting the catholyte to separation and purification, thereby obtaining 4-amino-3,6-dichloropicolinic acid, wherein the catholyte is prepared by adding the 4-amino-3,5,6-trichloropicolinic acid to an aqueous solution of an alkali metal hydroxide or alkali metal carbonate to obtain a mixture, subjecting the mixture to stirring at 50-100° C. until the mixture becomes a clear solution, and then cooling the clear solution down to 30-75° C. to obtain a clear catholyte.

2. The method according to claim 1, wherein the alkali metal hydroxide is NaOH or KOH, and the alkali metal carbonate is sodium carbonate or potassium carbonate.

3. The method according to claim 1, wherein in the aqueous solution of an alkali metal hydroxide or alkali metal carbonate, the concentration of the alkali metal hydroxide is 0.5-2 mol/L, and the concentration of the alkali metal carbonate is 0.25-1 mol/L; the molar ratio of the alkali metal hydroxide or alkali metal carbonate in the aqueous solution of an alkali metal hydroxide or alkali metal carbonate to the 4-amino-3,5,6-trichloropicolinic acid is 0.1-1:1.

4. The method according to claim 1, wherein the alkali metal hydroxide in the anolyte is NaOH or KOH, and the concentration of the alkali metal hydroxide in the anolyte is 0.5-10 mol/L.

5. The method according to claim 1, wherein the cathode is an activated silver mesh, and the activation method for the silver mesh comprises: in an H-type electrolytic cell with a Nafion 117 cation membrane as a diaphragm, using the silver mesh as a working electrode, graphite as a counter electrode, silver/silver chloride as a reference electrode, a 0.5 mol/L NaCl and 0.5 mol/L NaOH aqueous solution as a working electrode solution, and a 1.0 mol/L NaOH aqueous solution as a counter electrode solution, controlling the temperature of the working electrode solution at 20-25° C., first applying an anodic oxidation current of 0.3 A/dm$^2$ to the silver mesh until the electrode potential reaches ±0.7 vs. SHE, then reversing the current direction and applying a cathodic reduction current of 0.3 A/dm$^2$ to the silver mesh until the electrode potential reaches −0.4 vs. SHE; finally, removing the silver electrode and immersing the silver electrode in deionized water to obtain the activated silver mesh.

6. The method according to claim 1, wherein a current density for the electrolytic reaction is 2.2~20 A/dm$^2$, and the temperature for the electrolytic reaction is 30~80° C.

7. The method according to claim 1, wherein a current control method is as follows: during an initial stage of the electrolytic reaction, a current density of 8~20 A/dm$^2$ is used; during an intermediate stage, a current density of 4.5~11.2 A/dm$^2$ is used; and during a final stage, a current density of 2.2~5.5 A/dm$^2$ is used.

8. The method according to claim 1, wherein the diaphragm is a cation exchange membrane or a porous diaphragm.

9. The method according to claim 1, wherein a separation and purification method for the catholyte comprises: adjusting the pH of the catholyte to 1 using 36% mass concentrated hydrochloric acid at 85-90° C., and allowing the catholyte to cool naturally overnight for crystallization; filtering the precipitated crystals, washing the precipitated crystals with water, and drying the precipitated crystals at 80° C. to obtain snow-white crystals, which are the 4-amino-3,6-dichloropicolinic acid.

* * * * *